United States Patent [19]

Carolus et al.

[11] 4,190,842

[45] Feb. 26, 1980

[54] ANTENNA CABLE DRIVE AND STORAGE DRUM WITH STOP MECHANISM

[75] Inventors: David T. Carolus; Ralph W. Edwards, both of Dayton, Ohio

[73] Assignee: General Motors Corporation, Detroit, Mich.

[21] Appl. No.: 962,922

[22] Filed: Nov. 22, 1978

[51] Int. Cl.[2] ..... H01Q 1/10

[52] U.S. Cl. ..... 343/903

[58] Field of Search ..... 343/711, 715, 723, 903

[56] References Cited

U.S. PATENT DOCUMENTS 2,709,220 5/1955 Spector ..... 343/903

*Primary Examiner*—Eli Lieberman

*Attorney, Agent, or Firm*—Donald F. Scherer

[57] ABSTRACT

An antenna cable drive and storage drum is driven by an electric motor to extend and retract a cable during a predetermined number of revolutions of the drum. A reaction switch, sensitive to drum rotation forces occurring at full extension or retraction, controls motor stoppage at the fully extended and retracted positions. A rotatable gear member supported on a stationary member is driven by a single tooth on the drum. In the event that the normal cable reaction load is not present, the drum continues to rotate beyond the full extension or retraction point such that an interference condition occurs between the gear member and the single tooth resulting in a high reaction load on the drum causing actuating of the reaction switch to discontinue operation of the motor.

3 Claims, 3 Drawing Figures

ANTENNA CABLE DRIVE AND STORAGE DRUM WITH STOP MECHANISM

This invention relates to antenna cable drive and storage drums and more particularly to secondary stop controls for a drum which is normally controlled by a switch responsive to cable reaction.

It is an object of this invention to provide an improved antenna cable drive and storage drum wherein a rotatable gear member mounted on the housing is driven by a single tooth on the drum and wherein the gear member presents a reaction surface to the single tooth to impose a resistance to rotation of the drum if the drum is rotated more than necessary to fully extend or retract the cable.

It is another object of this invention to provide an improved cable drive and storage drum wherein a gear member having a number of spaced teeth at least equal to the number of revolutions to fully extend or retract the cable and a continuous circumferential surface intermediate the terminal tooth spaces is mounted on the housing and driven by a single tooth on the drum which contacts the continuous circumferential surface if the drum rotates more revolutions than required for full extension or retraction of the cable thereby creating a resistance to further rotation of the drum.

These and other objects and advantages of the present invention will be more apparent from the following description and drawings in which.

Figure 1:
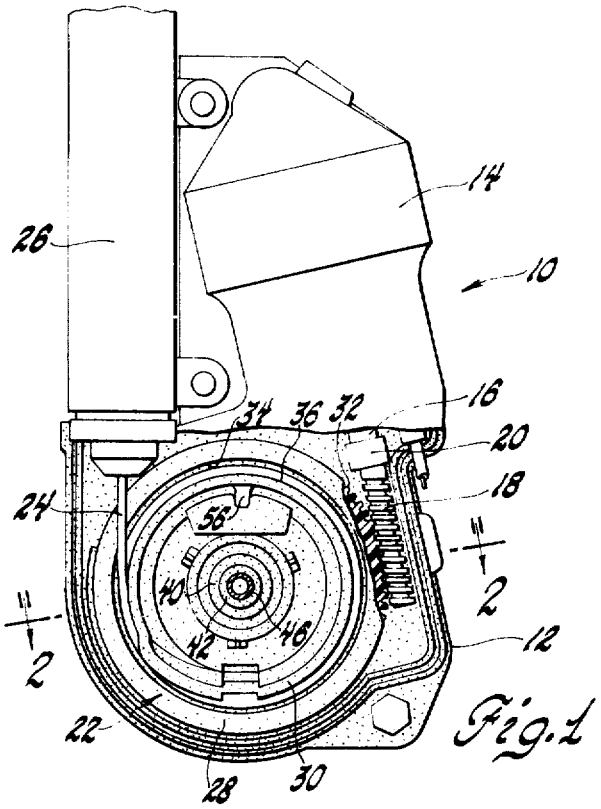
FIG. 1 is a side elevational view of a power antenna and drive mechanism.
Figure 2:
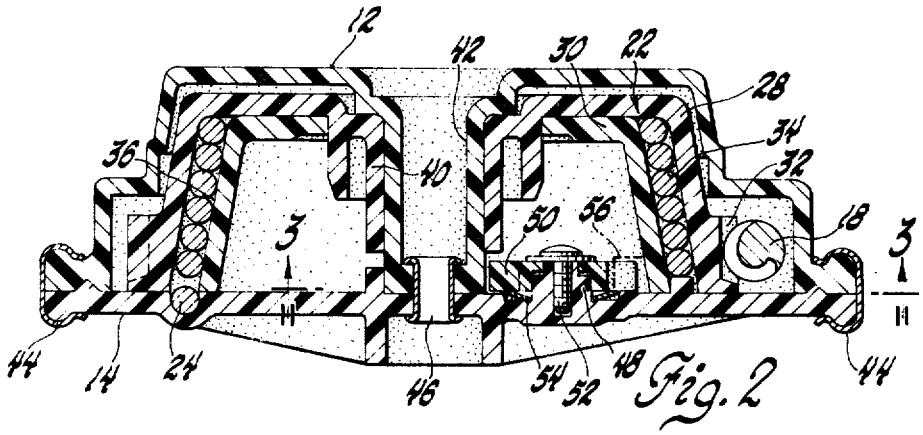
FIG. 2 is a sectional view taken along line 2—2 of FIG. 1.

Referring to the drawings, wherein the same characters represent the same or corresponding parts throughout the several views, there is seen an antenna drive mechanism generally designated 10 having a housing 12 and a cover 14. A conventional electric motor, not shown, is disposed in the housing 12 beneath cover 14 and has an output shaft 16 which drives a worm gear 18. A reaction switch 20 is operatively connected to the output shaft 16 and is preferably constructed in accordance with the reaction switch shown in U.S. Ser. No. 900,051, filed Apr. 26, 1978, and assigned to the assignee of the present invention. The worm gear 18 is drivingly connected to a drum assembly generally designated 22 which houses a cable 24 adapted to drive a telescoping antenna, not shown, which is housed in a mast jacket 26 secured to the mechanism 10. The drum 22, as best seen in FIG. 2, is comprised of an outer member 28 and an inner member 30 which are similar in construction to the members shown in the drive drum disclosed in U.S. Ser. No. 938,752, filed Sept. 1, 1978, and assigned to the assignee of the present invention.

The outer member 28 has formed on the outer periphery thereof, a worm gear 32 which meshes with the worm 18, and has a frustoconical surface 34 formed on the inner surface thereof which cooperates with a frustoconical surface 36 formed at the outer surface of inner member 30. The outer member 28 has an inner cylindrical component 40 which is rotatably supported on a cylindrical member 42 formed integrally with the housing 12. The cable 24 is stored in the space formed by the frustoconical surfaces 34 and 36 and is drivingly connected to the inner member 30 such that when the drum assembly 22 is rotated by the electric motor, the cable 24 will be extended from or retracted into the storage drum depending upon the direction of rotation of the electric motor.

The cover 14 is secured to the housing 12 by a plurality of spring clips 44 and a rivet member 46. A post 48 is formed integrally with the cover 14 and has rotatably disposed thereon a gear member 50 which is maintained in longitudinal position on the post 48 by a fastener 52. A spring washer 54 is disposed between the cover 14 and the gear member 50 and imposes an axial load between the gear 50 and the fastener 52 such that the gear member 50 will not be freely rotatable but must require a slight input force for rotation. Rotation of the gear member 50 is accomplished by a single tooth 56 which is formed integrally with the inner member 30 such that as the inner member 30 makes one complete revolution, the gear member 50 will be moved one tooth space in either a clockwise or counterclockwise direction depending upon the direction of rotation of the drive drum 22.

Figure 3:
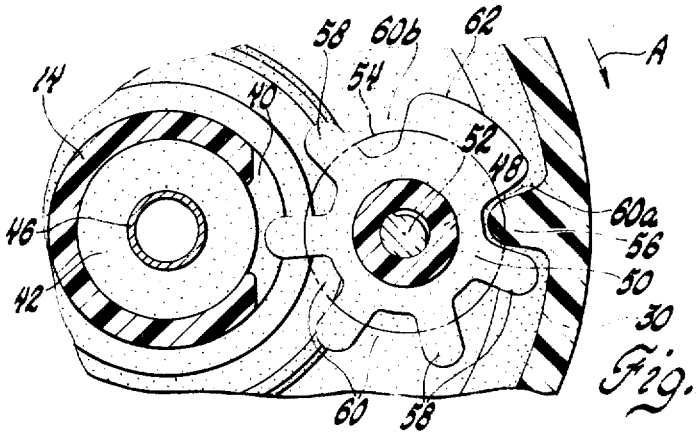
FIG. 3 is a sectional view taken along line 3—3 of FIG. 2.

As best seen in FIG. 3, the gear member 50 has a number of equally spaced teeth, such as 58, which are separated by equally sized tooth spaces, such as 60. Between the terminal tooth spaces **60*a* and 60*b*, the gear member 50 has a continuous circumferential surface 62 which is devoid of any spaces. If, as viewed in FIG. 3, the member 30 is rotated in the direction of Arrow A, it should be appreciated that one more complete revolution of member 30 will result in gear tooth 56 engaging or abutting against the circumferential surface 62 which will, of course, impose a resistance against further rotation of the inner member 30 and therefore drum assembly 22. If the inner member 30 is rotated in a direction opposite to Arrow A, it should be appreciated that each successive rotation of inner member 30 will result in gear member 50 advancing in a counterclockwise direction one tooth space until the tooth 56 is meshed in tooth space 60*b*. If inner member 30 continues to rotate one more revolution after space 60*b* is engaged, the tooth 56 will abut the circumferential surface 62 thereby imposing a high rotational resistance to the drum assembly 22. When the tooth 56 is engaged with tooth space 60*a*, the cable 24 is fully retracted and if connected to the telescoping mast, will impose a sufficient reaction load to drum 22 which will actuate the reaction switch 20 to discontinue operation of the electric motor, in accordance with the teaching of U.S. Ser. No. 900,051, such that the tooth 56 will not engage the circumferential surface 62 during normal operation. When the tooth 56 is meshed with tooth space 60*b*, the cable 24 and therefore the telescoping antenna will be fully extended and will again impose sufficient reaction load to cause switch 20 to discontinue operation of the electric motor such that tooth 56 will not engage the circumferential surface 62. Thus, the conventional and normal operation for the system will continue as long as the cable 24 remains drivingly connected between the drum assembly 22 and the telescoping antenna, not shown. If, however, for some reason the drive connection should be broken, the drum assembly 22 will not receive sufficient reaction loading to actuate switch 20 at the normal limits of full extension or retraction of the antenna. Under this condition, the drum 22 will continue to rotate until the single tooth 56 engages or abuts the circumferential surface 62 to cause the required reaction load to actuate switch 20**.

Should it become necessary for the tooth 56 to engage surface 62, the operator will be aware of the malfunction since the telescoping antenna will remain either fully extended or fully retracted and will therefore be alerted that he should seek assistance to repair the antenna cable 24. While the drawings show the gear member 50 as having a number of tooth spaces equal to the total revolutions for full extension or retraction, it will be appreciated that by judiciously sizing the tooth 56 and tooth spaces 60, a number of tooth spaces greater than the required number can be incorporated into the gear member 50 thereby permitting one or more full revolutions of the gear member 50, after full retraction or extension, prior to the stop control function of gear tooth 56 and circumferential surface 62 coming into play.

Obviously, many modifications and variations of the present invention are possible in light of the above teaching. It is therefore to be understood that within the scope of the appended claims, the invention may be practiced otherwise than as specifically described.

The embodiments of the invention in which an exclusive property or privilege is claimed are defined as follows:

1. An antenna cable drive comprising; a stationary housing; a reversible rotatable drive and storage drum mounted on said housing; means for rotating said drum; a cable drivingly connected to said drum and being stored thereon and being extended from and retracted into said housing by rotation of said drum in one direction or the other during a predetermined number of revolutions of said drum in each respective direction; and drum rotation responsive means including gear means rotatably mounted on said housing having a number of equally spaced teeth greater than the predetermined number and a single wide tooth, and a single tooth on said drum meshing in the spaces between said equally spaced teeth to rotate said gear means one tooth space for each revolution of said drum during said predetermined number of revolutions and abutting the outer surface of said single wide tooth if said drum rotates a number of revolutions greater than said predetermined number thereby restricting further rotation of said drum.

2. An antenna cable drive comprising; a stationary housing; a reversible rotatable drive and storage drum mounted on said housing; means for rotating said drum; a cable drivingly connected to said drum and being stored thereon and being extended from and retracted into said housing by rotation of said drum in one direction or the other during a predetermined number of revolutions of said drum in each respective direction; and drum rotation responsive means including gear means rotatably mounted on said housing having a number of equally spaced teeth equal to or greater than the predetermined number and a continuous circumferential surface intermediate the terminal spaces of said equally spaced teeth, and a single tooth on said drum meshing in the spaces between said equally spaced teeth to rotate said gear means one tooth space for each revolution of said drum during said predetermined number of revolutions and abutting the continuous circumferential surface of said gear means if said drum rotates a number of revolutions greater than said predetermined number thereby restricting further rotation of said drum.

3. An antenna cable drive comprising; a stationary housing; a reversible rotatable drive and storage drum mounted on said housing; means for rotating said drum; a cable drivingly connected to said drum and being stored thereon and being extended from and retracted into said housing by rotation of said drum in one direction or the other during a predetermined number of revolutions of said drum in each respective direction; and drum rotation responsive means including gear means rotatably mounted on said housing having a number of equally spaced teeth equal to or greater than the predetermined number and a circumferential portion devoid of teeth, and a single tooth on said drum meshing in the spaces between said equally spaced teeth to rotate said gear means one tooth space for each revolution of said drum during said predetermined number of revolutions and abutting said circumferential portion if said drum rotates a number of revolutions greater than said predetermined number thereby restricting further rotation of said drum.

* * * * *